US005512347A

United States Patent [19]

Chu

[11] Patent Number: 5,512,347

[45] Date of Patent: Apr. 30, 1996

[54] CANVAS REINFORCEMENT STRUCTURE

[76] Inventor: Liu Chu, No. 79, Tai Ming Rd., Wu Jih Hsiang, Taichung Hsien, Taiwan

[21] Appl. No.: 179,688

[22] Filed: Jan. 11, 1994

[51] Int. Cl.[6] ..... B32B 3/10

[52] U.S. Cl. ..... 428/81; 428/45; 428/120; 428/121; 428/124; 428/131; 428/137; 428/126; 428/130; 428/99; 135/119; 248/500

[58] Field of Search ..... 428/45, 81, 120, 428/121, 124, 131, 137, 126, 130, 99; 135/119; 248/500

[56] References Cited

U.S. PATENT DOCUMENTS

| | | | |
|---|---|---|---|
| 2,006,673 | 7/1935 | Crawford | 383/119 |
| 4,777,071 | 10/1988 | Liu | 428/120 |
| 5,228,261 | 7/1993 | Watkins | 57/702 |
| 5,415,915 | 5/1995 | Oh | 428/99 |

*Primary Examiner*—George F. Lesmes
*Assistant Examiner*—Kathleen L. Choi
*Attorney, Agent, or Firm*—Larson & Taylor

[57] ABSTRACT

The present invention relates to a canvas reinforcement structure which enables canvas to become strong enough to sustain greater external force (such as wind), and enlarge tension strength to avoid breakage as well as form overall restraint effect for obtaining whole covering performance; it comprises reinforcement corner block mounted on respective corners of canvas, and corner block including upper and lower reinforcement pieces to form contact limited room and outlet hole for retaining canvas and therefore rivetting together with canvas by means of rivet; central position having through hole, collar rope hole for building up each corner of canvas with resistant ability against tearing force without risk of breakage; and restraint portion is folded with appropriate width of canvas for inserting restraint rope and auxiliary rope wrapping body so as to strengthen resistance of canvas periphery against lifting over as well as reinforcing the effect of secure tying. The improved canvas for corner strength and covering in position compared with conventional canvas, may achieve endurable effect against breakage and excellent covering performance thereof.

5 Claims, 5 Drawing Sheets

CANVAS REINFORCEMENT STRUCTURE

SUMMARY OF THE INVENTION

The present invention relates to an improvement for canvas structure, and more particularly to the improvement for canvas reinforcement structure which includes reinforcing corner blocks, restrain portion, restrain rope to increase overall strength of canvas hereof, and especially further increase strength of canvas corners so that the canvas in use for covering may be overally endurable against wind blowing, excellent in covering performance, not liable to breakage while to achieve long life span thereof.

It is very popular to use canvas for covering an article. The conventional canvas involves only a design of rope hole without any other treatment! Referring to FIG. 1, a canvas 1 is folded at two peripheral sides respectively and connected together by sewing to form folding layer 2, including rope hole 4 on the corner, rope wrapping body 3 rivetted around the periphery of rope hole 4; in other words, folding layer 2 is intended for building up the strength and covering force (with the aid of weight) of canvas, and rope wrapping body 3 increases the strength of rope hole 4. However, it is understood that there are following defects:

(1) Limited strength is increased with the aid of rope wrapping body 3, i.e. without any help to the area of canvas corners sustaining tearing and pressure force. The strength on the corners of canvas is formed by folding layer 2 only; another, rope wrapping body 3 breaking or erroded would cause poor strength to the corners and rope holes of canvas. Therefore, structural strength of conventional canvas is not solid enough.

(2) Limited covering strength is increased with the aid of folding layer 2 since wind force not only could lift, push from bottom side of canvas but put pressure upon the web of canvas to result in poor weathering resistance of canvas whereby it appears the problem of failure to cover in a tight manner due to canvas wave motion; because conventional canvas has no design of reinforcement on peripheral area to resist against tearing force so its covering performance is inferior.

DETAILED DESCRIPTION OF PREFERRED EMBODIMENT

Figure 1:
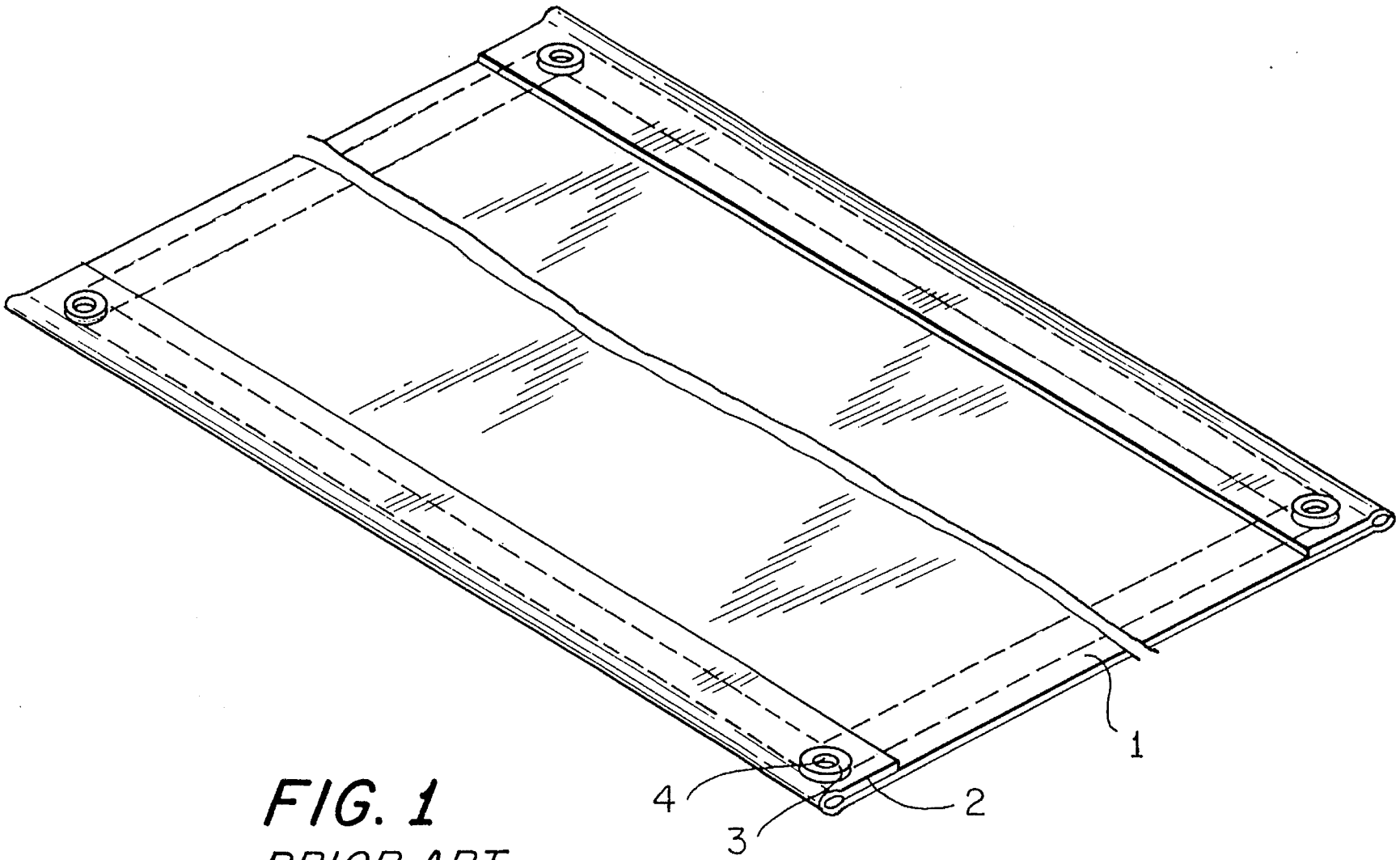
FIG. 1 PRIOR ART
FIG. 1 is a top perspective view of conventional canvas.
Figure 2:
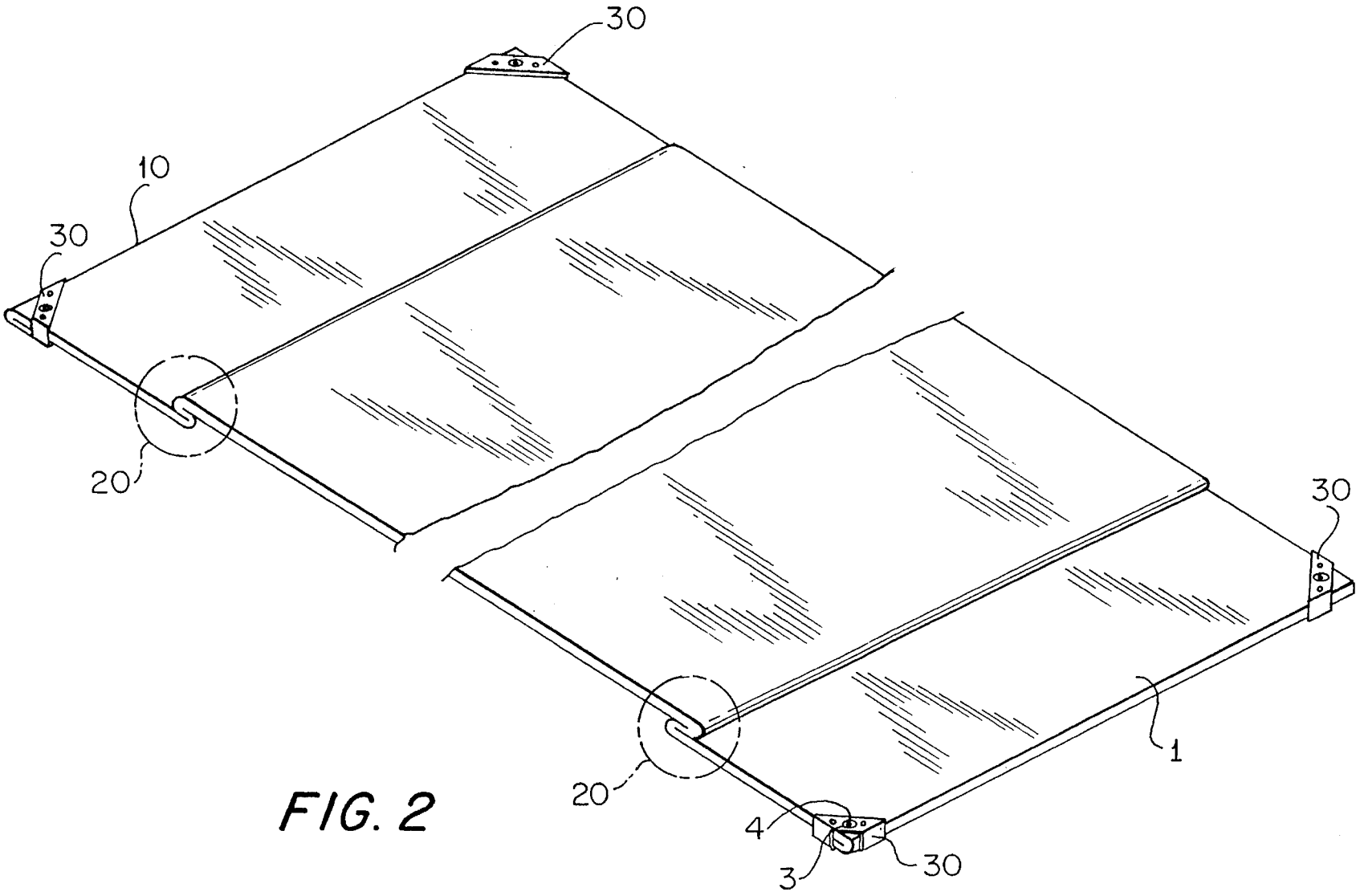
FIG. 2 is a top perspective view of the present canvas.

Referring to FIG. 2, the present invention relates to improvements for the corners and each lateral part of canvas 1 so that high strength of canvas as a whole is achieved. It comprises reinforcement corner block 30 and rope wrapping body 3 on respective corners of canvas 1, restraint portion 20 as folded with appropriate width on each lateral part of canvas so as to cause canvas corners with resistance against tearing force of rope, an increase of covering strength on each lateral part of canvas whereby a canvas with excellent covering effect as a whole and long life span is accomplished.

Figure 3:
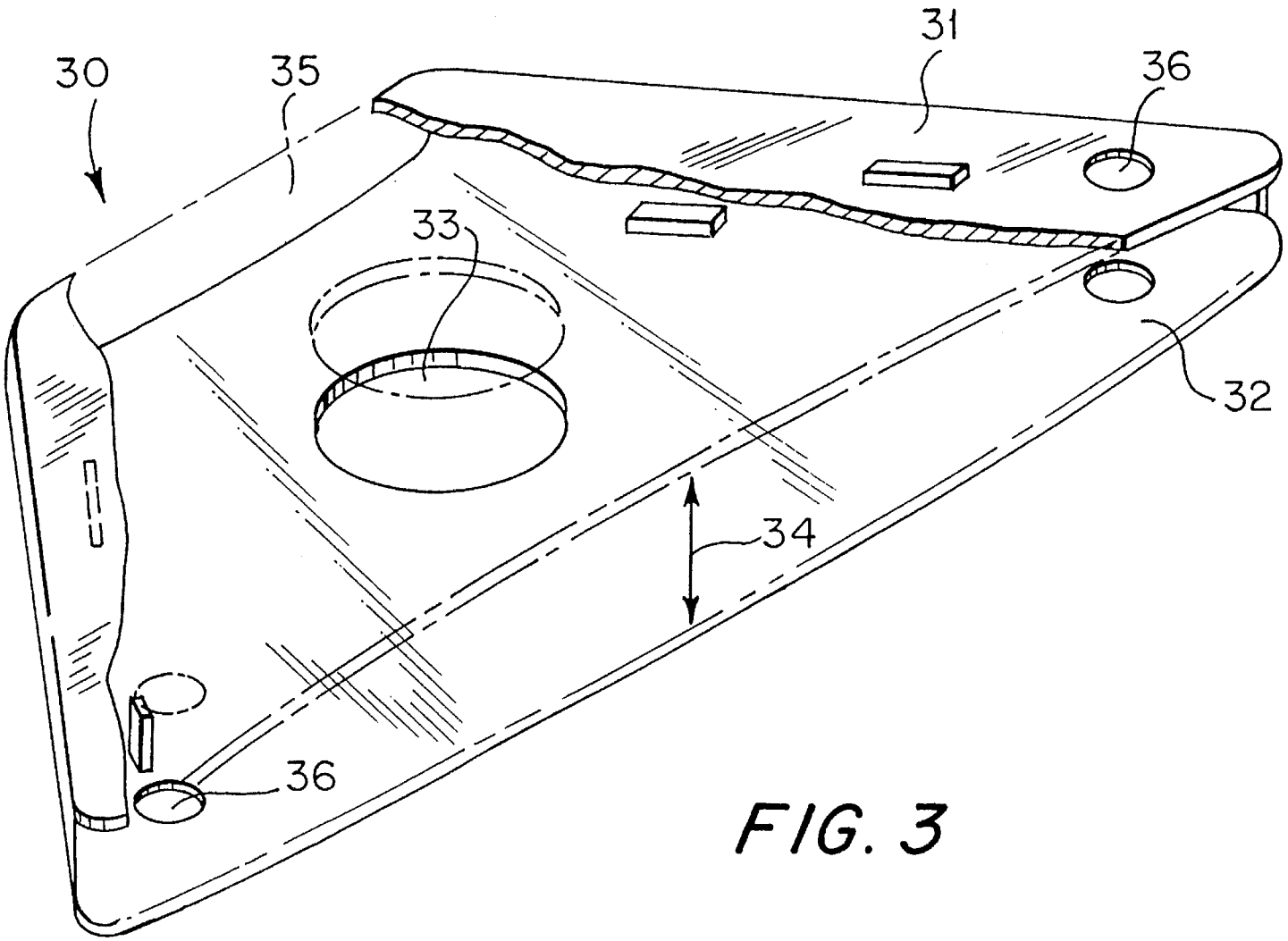
FIG. 3 is a top perspective view showing a reinforcement corner block according to the present invention.

Referring to FIG. 3, said reinforcement corner block 30 is, a one piece, integral gusset having a hollow body in accordance with the corner shape of canvas 1, comprising upper and lower reinforcement pieces 31, 32, contact limited room 34, outlet hole 35, and further including through holes 33 and rivet hole 36. The assembly of corner block 30 with canvas 1, as shown in FIGS. 3, 4 and 5, is achieved by inserting canvas corner having folding and restraint rope 41 through contact limited room 34 and extending out of outlet hole 35; canvas having rope hole 4 provided for rivetted together with upper and lower reinforcement pieces 31, 32 by using rivet 50 fitting rivet hole 36, and rope wrapping body 3 can be rivetted into through hole 33 on reinforcement corner block 30 for rivetting and protecting canvas 1; in other words, canvas 1 corner can be overally wrapped and protected by reinforcement corner block 30 to form a greater area of reinforcement.

Figure 5:
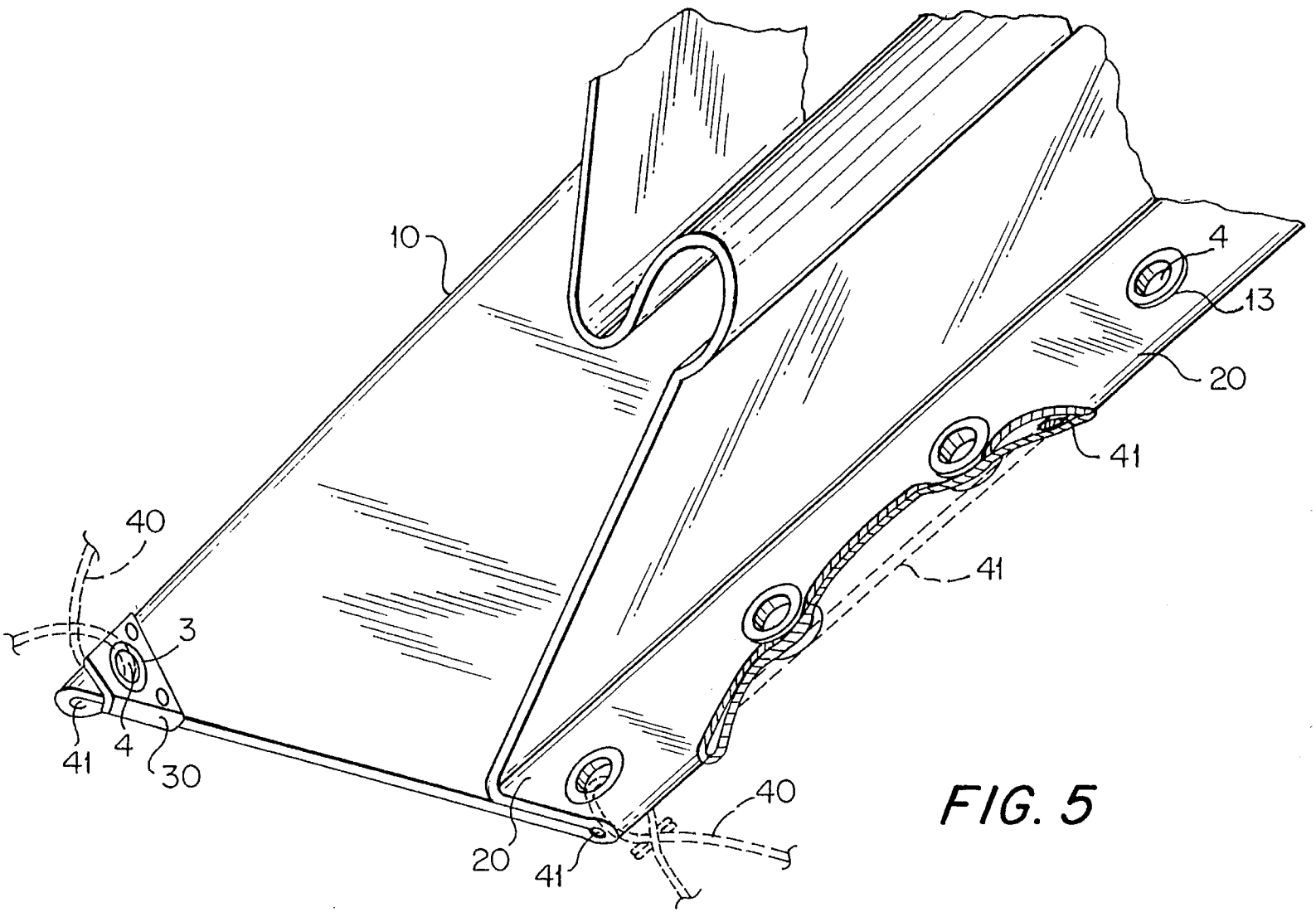
FIG. 5 is a diagramatic perspective view showing the structure of restraint portion according to the present invention.

Referring to FIG. 5, restraint portion 20 is folded with appropriate width of canvas 1 and contains restraint rope 41 to form a strip shape after sewing; another, auxiliary rope wrapping body 13 with several rope holes rivetting through restraint portion 20 may be added subject to actual requirement, for tying auxiliary pull rope 40.

Figure 4A:
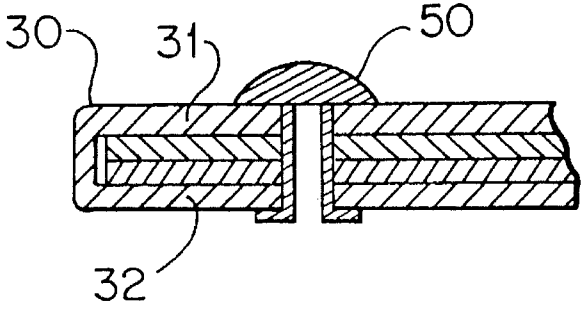
FIG. 4A is a cross-sectional view taken along line 4A—4A of FIG. 4.
Figure 4:
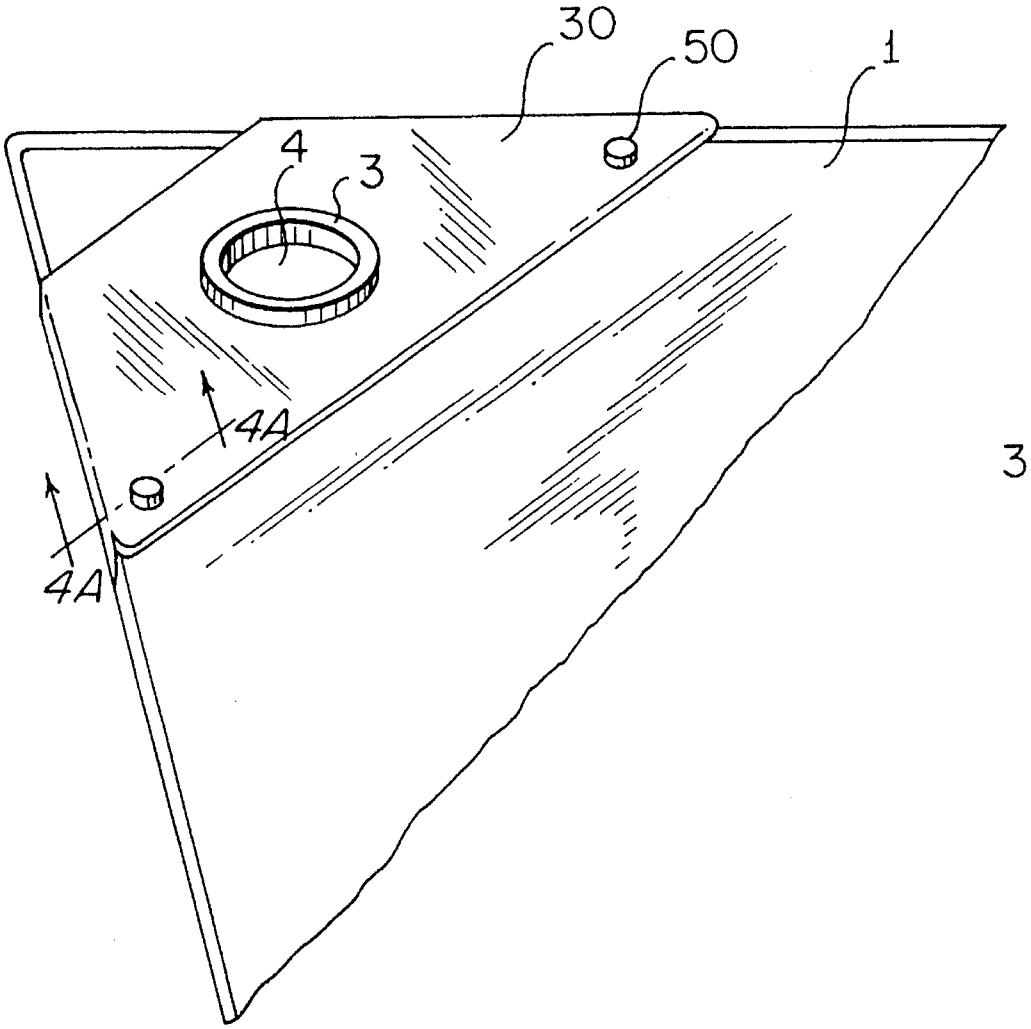
FIG. 4 is a top perspective and sectional view showing the assembly of reinforcement corner block according to the present invention.

With aforesaid canvas 1 reinforcement corner block 30, restraint portion, the present invention in use may obtain following advantages:

(1) Referring to FIGS. 2, 4, periphery 10 of canvas 1 containing restraint rope 41, and each corner having reinforcement corner block 30 may enable reinforcement on rope wrapping body 3 as well as reinforced strength for reinforcement corner block 30 as a result of greater area of sustaining external force when pull rope inserting through rope hole 4 of rope wrapping body 3 is tied up with external goods; restraint rope 41 mounting through periphery of canvas 1 is clearly understood that restraint force can be increased to overall periphery of canvas and strong enough to resist against lifting force exerted by wind blowing when canvas 1 periphery contains rope tied up with external goods.

(2) Referring to FIGS. 2, 5, each lateral part of canvas 1 having strip type restraint portion 20 is clearly understood as to form a thicker and heavier multi-layer structure so that lateral part may have better resistance against push, lift by wind force when canvas is used, and especially restraint portion 20 contains restraint rope 41 that increases overall restraint force of restraint portion 20, and auxiliary rope wrapping body 13 with outlet hole 4 may be provided as additional pull rope 40 tying device for the user subject to the need of use, which is available in conventional canvas; therefore the present invention has restraint portion 20 to increase the effect of covering performance of canvas 1.

What is claimed is:

1. An improved reinforced canvas having at least one corner comprising a reinforcement corner block comprised of a one piece integral gusset having a hollow body mounted on the corner of said canvas, said body having spaced apart upper and lower reinforcement pieces and end pieces connecting said upper and lower pieces, said upper, lower and end pieces defining an internal contact limited room for receiving the corner of said canvas, an outlet hole through which the tip of the canvas corner can extend, and further including a through hole and a rivet hole, said through hole and said rivet hole extending through said upper and lower reinforcement pieces;

said canvas having a restraint portion with fixed holes therethrough and an auxiliary rivet extending through said fixed holes;

at least one rivet in said rivet hole of said reinforcement corner block for rivetting said canvas corner together with said reinforcement corner block canvas; and a main rivet rivetted into said through hole, said main rivet and said at least one rivet to increase overall strength of said canvas corner.

2. The improvement for canvas reinforcement according to claim 1, wherein said restraint portion contains a restraint rope which increases the covering strength together with the aid of restraint portion thickness; and a restraint rope, and an auxiliary rope wrapping body that is provided for tying a pull rope when needed to help strengthen the covering performance of said canvas.

3. An improved reinforced canvas as claimed in claim 1 and wherein said canvas has a main portion and an edge portion comprised of an edge piece of said canvas folded over and attached to said main portion, thereby defining a bore along the periphery of said edge portion, and a restraint rope in said bore.

4. An improved reinforced canvas as claimed in claim 3 wherein said main rivet has a rope wrapping body and said restraint rope is attached to said rope wrapping body.

5. A canvas having a reinforced corner with a tip, said canvas comprising a main portion and an edge portion, said edge portion including said corner and comprised of an edge piece of said canvas folded over and attached to said main portion, thereby defining a bore along the periphery of said edge portion, a reinforcement corner gusset block comprised of a one piece integral hollow body having spaced apart upper and lower reinforcement pieces and end pieces connecting said upper and lower pieces, said upper, lower and end pieces defining an enclosed internal opening for receiving the corner of said canvas, an outlet hole through which said tip of the canvas corner extends, a through hole, and a rivet hole;

a rivet in said rivet hole for rivetting said canvas corner together with said gusset block;

a main rivet having a rope wrapping body rivetted into said through hole; and a restraint rope attached to said rope wrapping body and extending in said bore.

* * * * *